US008873792B2

(12) United States Patent
Shao et al.

(10) Patent No.: US 8,873,792 B2
(45) Date of Patent: Oct. 28, 2014

(54) SPEAKER

(75) Inventors: Yi Shao, Shenzhen (CN); Wei Song, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 0 days.

(21) Appl. No.: 13/190,011

(22) Filed: Jul. 25, 2011

(65) Prior Publication Data

US 2012/0106775 A1 May 3, 2012

(30) Foreign Application Priority Data

Nov. 1, 2010 (CN) ..... 2010 2 0587634 U

(51) Int. Cl.
*H04R 9/06* (2006.01)
*H04R 9/04* (2006.01)

(52) U.S. Cl.
CPC ..... *H04R 9/043* (2013.01); *H04R 9/063* (2013.01)
USPC ..... 381/401; 381/400; 381/412; 381/396; 381/150

(58) Field of Classification Search
USPC ..... 381/412, 420–421, 400–401, 403, 150, 381/396, 398; 181/171–173
See application file for complete search history.

(56) References Cited

U.S. PATENT DOCUMENTS

| | | | | |
|---|---|---|---|---|
| 5,546,069 | A * | 8/1996 | Holden et al. | 340/407.1 |
| 8,139,813 | B2 * | 3/2012 | Kobayashi et al. | 381/398 |
| 8,577,075 | B2 * | 11/2013 | Yan | 381/407 |
| 2011/0051987 | A1 * | 3/2011 | Ueda et al. | 381/412 |
| 2011/0293133 | A1 * | 12/2011 | Yan | 381/401 |

* cited by examiner

*Primary Examiner* — Ahmad Matar
*Assistant Examiner* — Sabrina Diaz
(74) *Attorney, Agent, or Firm* — Anova Law Group, PLLC

(57) ABSTRACT

A speaker includes a base defining a pair of receiving cavities separated from each other in a longitudinal direction and an engaging portion disposed between the pair of receiving cavities, a pair of magnetic circuit systems received into the pair of the receiving cavities, a diaphragm attached on the base, a pair of voice coil members connecting with the diaphragm, and a suspension mounted on the base. The suspension defines a pair of separating portions separated from each other in a lateral direction. Each separating portion defines a fixing portion engaging with the engaging portion of the base, a pair of connecting portions extending from two ends of the fixing portion and towards the diaphragm, and a pair of supporting portions connecting with the connecting portion for engaging with the pair of voice coil members, respectively.

18 Claims, 4 Drawing Sheets

SPEAKER

FIELD OF THE INVENTION

The present disclosure relates to the art of speakers and, particularly to a speaker having a suspension.

DESCRIPTION OF RELATED ART

Generally, an electronic device, such as a mobile phone, uses a speaker as a sound generator.

Typically, a related speaker includes a base defining a pair of receiving cavities separated from each other in space, a diaphragm attached on the base, a suspension mounted on the base, a pair of voice coil members fixed on the suspension and connecting with the diaphragm, and a pair of magnetic circuit systems received in the pair of the receiving cavities respectively for driving the voice coil members to vibrate along a vibrating direction. The base defines a bottom portion and a side portion extending from the bottom portion. The suspension attaches on the side portion of the base and defines a pair of separating portions separated from each other in space. The pair of separating portions has the same structure to each other. Each separating portion defines a pair of supporting portions for engaging with the pair of voice coil members, a connecting portion connecting with one end of the pair of supporting portions and a pair of fixing portions extending from another end of the pair of supporting portions and away from the connecting portion for engaging with the side portion of the base. The connecting portion is disposed between the pair of separating portions.

The fixing portions are provided on the two sides of the suspension.

When the suspension following with the voice coil members vibrates along the vibrating direction repeatedly, a force generated from the voice coil members is mainly applied on the supporting portions of the suspension, thereby increasing the distortion or deformation of the suspension.

Therefore, it is desirable to provide a speaker which can overcome the above-mentioned problem.

DETAILED DESCRIPTION

Figure 1:
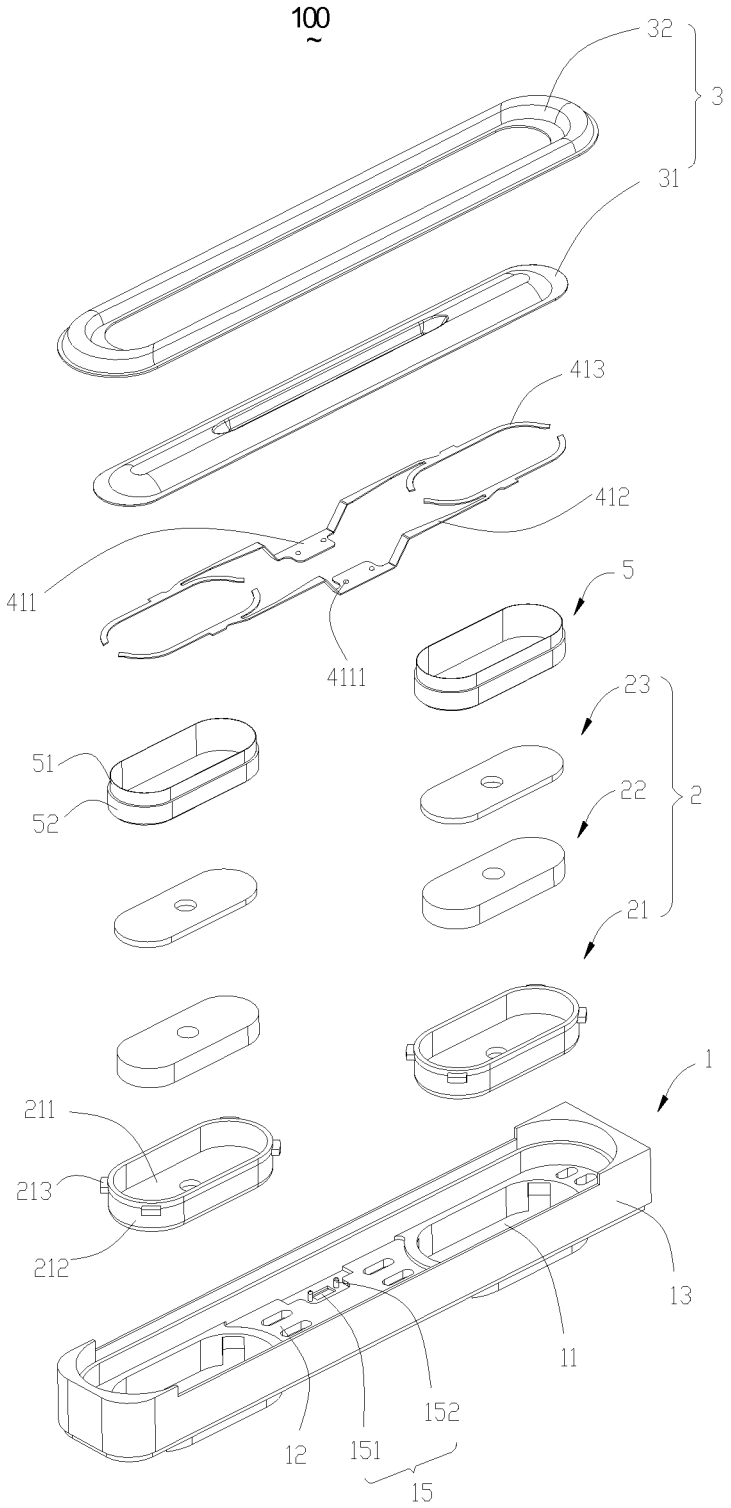
FIG. 1 is an illustrative exploded view of a speaker in accordance with an exemplary embodiment of the present invention.
Figure 2:
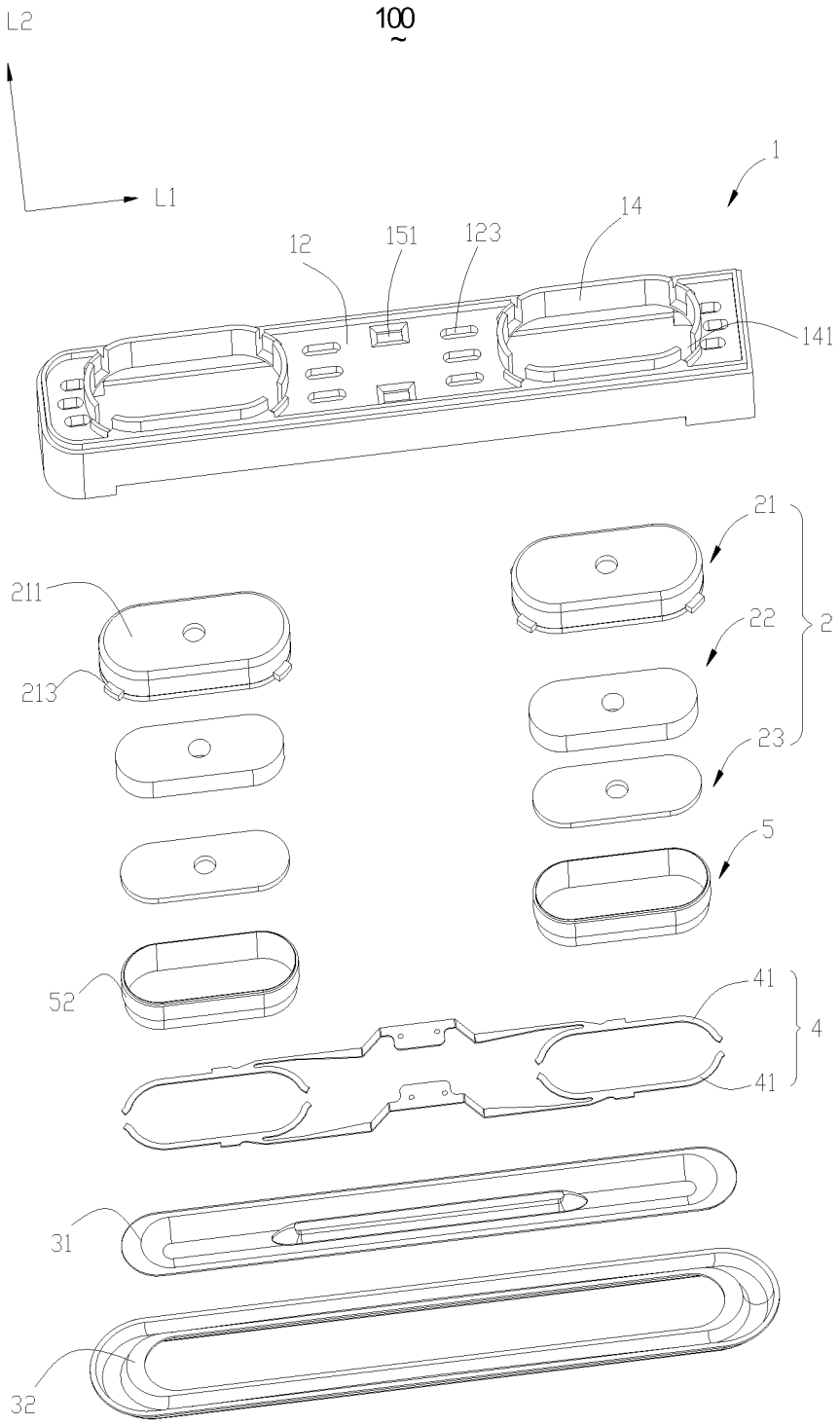
FIG. 2 is similar to FIG. 1, but from another aspect.
Figure 3:
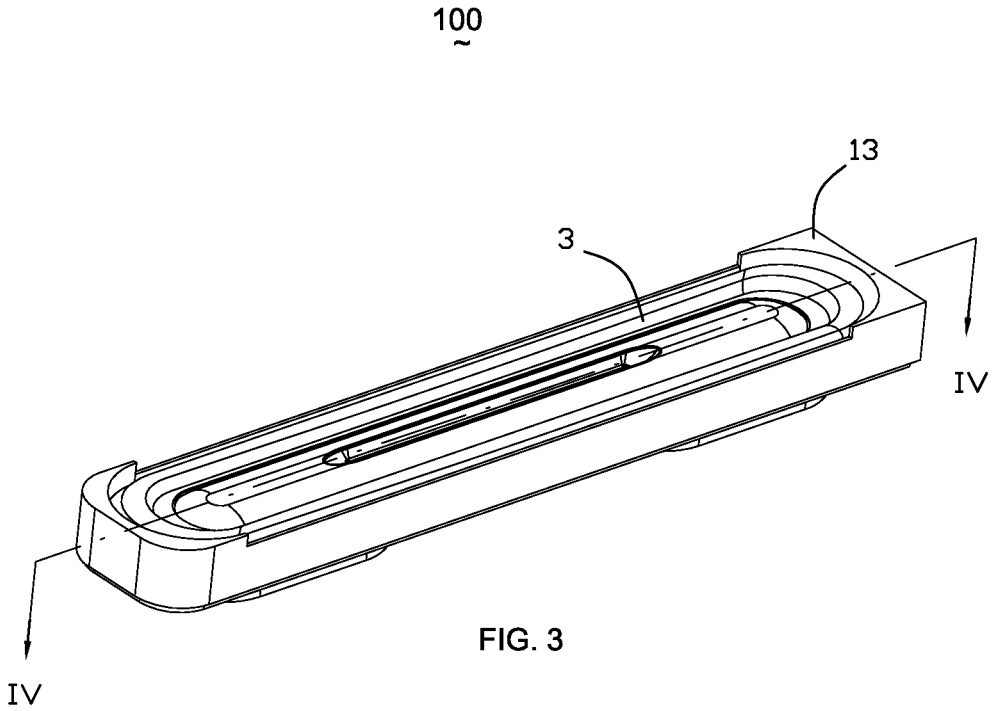
FIG. 3 is an assembled view of the speaker.
Figure 4:
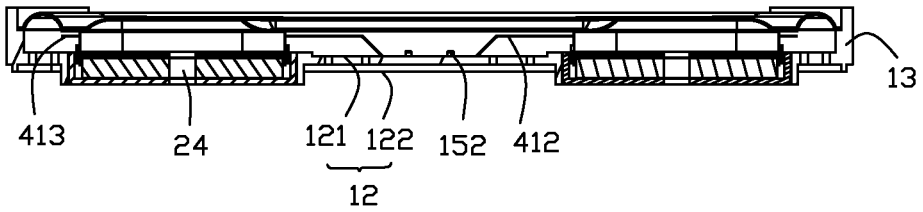
FIG. 4 is an enlarged cross-sectional view of the speaker along line IV-IV in FIG. 3.
Figure 5:
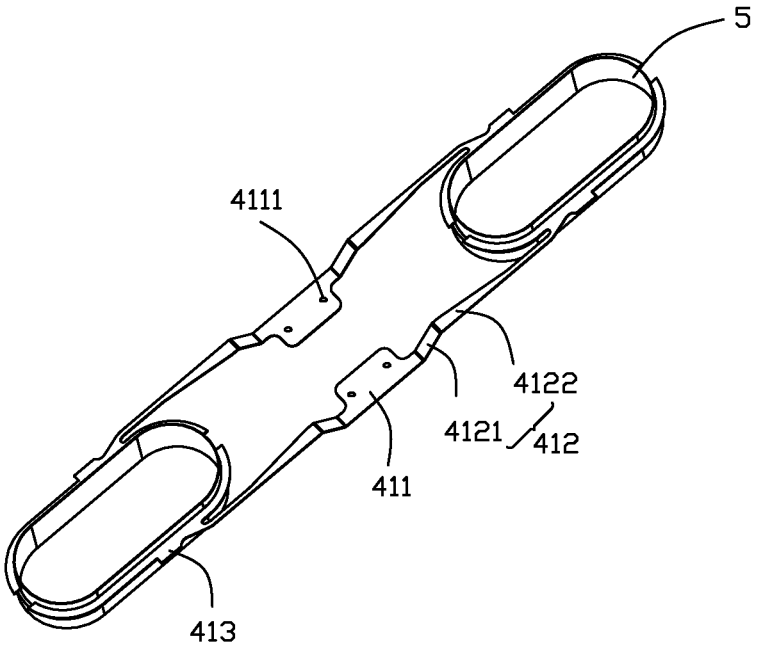
FIG. 5 is illustrative assembled view of the suspension and the voice coil members of the speaker.
Figure 6:
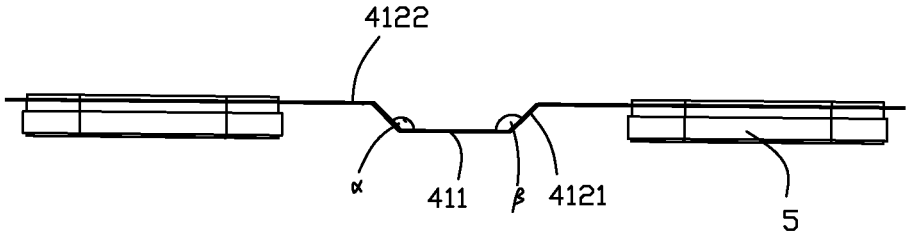
FIG. 6 is similar to FIG. 5, but from another aspect.

Referring to FIGS. 1 and 2, a speaker 100, in the exemplary embodiment of the present invention, defines a longitudinal direction L1 and a lateral direction L2 perpendicular to the longitudinal direction L1, as shown in FIG. 2. The speaker 100 comprises a base 1 defining a pair of receiving cavities 11 separated from each other in a longitudinal direction L1, a pair of magnetic circuit systems 2 received in the pair of the receiving cavities 11 respectively, a diaphragm 3 attached to the base 1, a suspension 4 mounted on the base 1, and a pair of voice coil members 5 connecting with the diaphragm 3 for driving the diaphragm 3 to vibrate along a vibrating direction.

Referring to FIG. 1, the diaphragm 3 includes a center portion 31 and a peripheral portion 32 coupled with the center portion 31. In the exemplary embodiment, the diaphragm 3 is made up of two parts. However, in fact, the diaphragm may be one-piece. The voice coil members 5 and the suspension 4 are directly connected with the peripheral portion 32 of the diaphragm 32, respectively.

Referring to FIG. 1, each voice coil member 5 receives current from an external circuit via the suspension 4 and defines a voice coil bobbin 51 and a voice coil 52 wound around an outer circumferential surface of the voice coil bobbin 51. Each voice coil 52 is columned configuration and wound spiral of two or more turns of metal wire, such as copper wire.

Referring to FIGS. 1 to 6, the suspension 4 defines a pair of separating portions 41 separated from each other in a lateral direction L2. The suspension 4 is made of conductive material for providing the current to the voice coils 52. The pair of separating portions 41 has the same structure to each other. Each separating portion 41 defines a fixing portion 411, a pair of connecting portions 412 extending from two ends of the fixing portion, and a pair of supporting portions 143 connecting with the pair of connecting portions 412 for engaging with the pair of voice coil members 5, respectively.

The fixing portions 411 are parallel to the supporting portions 413. Each connecting portion 412 defines a first connecting portion 4121 extending upwardly from the fixing portion 411 and a second connecting portion 4122 connecting with the first connecting portion 4121 and being coplanar with respect to the supporting portions 413. The supporting portions 413 of each separating portion 41 are symmetrical with respect to the fixing portion 411 of each separating portion 41. Each fixing portion 411 defines at least one fixing hole 4111. The connecting portions 412 of each separating portion 41 are also symmetrical with respect to the fixing portion 411 of each separating portion 41. Each connecting portion 412 connects with a middle of each supporting portion 413. Angles between the fixing portion and the pair of connecting portions of each separating portion $\alpha$ and $\beta$ are same to each other.

Referring to FIGS. 1 to 4, each magnetic circuit systems 2 defines a yoke 21, a magnet 22 mounted on the yoke 21, a plat pole 23 attached onto an upper surface of the magnet, a first aperture 24 passed therethrough in a center, and a magnetic gap (no labeled) defined on an outer surface of the magnet and an inner surface of the yoke. Each voice coil member 5 is partially inserted into the magnetic gap. Each yoke 21 includes a bottom portion 211, a side portion 212 perpendicularly extending upwardly from the bottom portion 211, and a plurality of engaging bars 213 extending from an upper end of the side portion 212. The bottom portion 211 is a circular plate and the side portion 212 is an annular configuration.

The base 1 defines a body portion 12, a surrounding portion 13 surrounding the body portion 12, a pair of receiving cavities 11 separated from each other in the longitudinal direction L1 and drilled from an upper surface 121 of the body portion 12 completely through a lower surface 122 of the body portion 12, a sidewall 14 completely surrounding each receiving cavity 11 and extending from the upper surface 121 of the body portion 12 to the lower surface 122 and away from the body portion 12 for engaging with the yoke 21, and an engaging portion 15 extending from the upper surface 121 of the body portion 12 towards the lower surface 122 of the body portion 12 and positioned between the pair of receiving cavities 11. The sidewall 14 defines a plurality of engaging holes 141 for abutting against the engaging bars 213 of the yoke 21. The engaging portion 15 defines a pair of through holes 151 and a plurality of fixing posts 152. The fixing portions 411 of the suspension electrically connect with the external circuit via the through holes 151. The fixing posts 152 cooperate with the fixing hole 4111 for fixing the suspension 4 on the base 1 firmly. In the exemplary embodiment, the engaging portion 15 is made up of two parts separated from each other in the lateral direction L2 for engaging with the pair of fixing portions 411 of the suspension 41, respectively. However, in fact, the engaging portion 15 may be one-piece. The body portion 12 defines a plurality of second apertures 123.

It is understood that in an alternative exemplary embodiment, the engaging portion extends from the upper surface of the body portion and away from the lower surface of the body portion.

It is understood that in an alternative exemplary embodiment, either the suspension or the voice coil indirectly connects with the diaphragm.

It is understood that in an alternative exemplary embodiment, the engaging portion is provided on the surrounding portion.

The engaging portion disposed between the pair of receiving cavities for supporting the fixing portions of the suspension, thereby preventing the distortion and deformation of the suspension when voice coil member vibrates along the vibrating direction repeatedly.

It will be understood that the above particular embodiment is shown and described by way of illustration only. The principles and the features of the present disclosure may be employed in various and numerous embodiments thereof without departing from the scope of the disclosure as claimed. The above-described embodiment illustrates the scope of the disclosure but do not restrict the scope of the disclosure.

What is claimed is:

1. A speaker comprising:

a base defining a pair of receiving cavities and an engaging portion, the pair of receiving cavities separated from each other in a longitudinal direction, the engaging portion disposed between the pair of receiving cavities;

a pair of magnetic circuit systems received into the pair of receiving cavities, respectively;

a diaphragm attached to the base;

a pair of voice coil members for driving the diaphragm to vibrate along a vibrating direction; and;

a suspension mounted on the base and defining a pair of separating portions separated from each other in a lateral direction perpendicular to the longitudinal direction, each separating portion defining a fixing portion engaging with the engaging portion of the base, a pair of connecting portions extending upwardly from two ends of the fixing portion towards the diaphragm, and a pair of supporting portions connecting with the connecting portion for engaging with the pair of voice coil members and vibrating together with the pair of voice coil members, respectively;

wherein, when the supporting portions vibrate relative to the engaging portion, the fixing portion is static relative to the engaging portion.

2. The speaker as claimed in claim 1, wherein each connecting portion defines a first connecting portion extending upwardly from the fixing portion and a second connecting portion connecting with the first connecting portion.

3. The speaker as claimed in claim 2, wherein the second connecting portions are coplanar with respect to the supporting portions.

4. The speaker as claimed in claim 3, wherein the fixing portion of each separating portion is parallel to the supporting portions of each separating portion.

5. The speaker as claimed in claim 4, wherein angles between the fixing portion and the pair of connecting portions of each separating portion are same to each other.

6. The speaker as claimed in claim 5, wherein each connecting portion connects with a middle of each supporting portion.

7. The speaker as claimed in claim 1, wherein the base defines a body portion and a surrounding portion surrounding the body portion.

8. The speaker as claimed in claim 7, wherein the engaging portion extends from an upper surface of the body portion towards a lower surface of the body portion.

9. The speaker as claimed in claim 7, wherein the engaging portion extends from an upper surface of the body portion and away from a lower surface of the body portion.

10. The speaker as claimed in claim 7, wherein the engaging portion is provided on the surrounding portion.

11. The speaker as claimed in claim 8, wherein the engaging portion defines a pair of through holes.

12. The speaker as claimed in claim 11, wherein each fixing portion defines at least one fixing hole and the engaging portion defines even fixing posts cooperative with the fixing holes for fixing the suspension on the base firmly.

13. The speaker as claimed in claim 12, wherein the supporting portions of each separating portion are symmetrical with respect to the fixing portion of each separating portion.

14. The speaker as claimed in claim 13, wherein the connecting portions of each separating portion are symmetrical with respect to the fixing portion of each separating portion.

15. The speaker as claimed in claim 14, wherein each magnetic circuit system defines a first aperture passed therethrough in a center.

16. The speaker as claimed in claim 15, wherein each magnetic circuit system defines a yoke and the yoke includes a bottom portion, a side portion perpendicularly extending upwardly from the bottom portion, and a plurality of engaging bars extending from an upper end of the side portion.

17. The speaker as claimed in claim 16, wherein the base defines a sidewall completely surrounding each receiving cavity and the sidewall defines a plurality of engaging holes for engaging with the engaging bars.

18. A speaker comprising:

a base defining a pair of receiving cavities and an engaging portion, the pair of receiving cavities separated from each other in a longitudinal direction, the engaging portion disposed between the pair of receiving cavities;

a pair of magnetic circuit systems received into the pair of receiving cavities, respectively; a diaphragm attached to the base;

a pair of voice coil members for driving the diaphragm to vibrate along a vibrating direction; and a suspension mounted on the base and having a stable portion mounted on the engaging portion and a pair of moving portions connected with the stable portion and positioned at two ends of the stable portion for fixing the voice coil members on the suspension;

wherein each moving portion has a connecting portion extending upwardly from one end of the stable portion towards the diaphragm and a supporting portion connecting with the connecting portion for engaging with the corresponding voice coil member; and wherein when the moving portions vibrate relative to the engaging portion, the stable portion is static relative to the engaging portion.

* * * * *